US011064740B2

(12) United States Patent
Ouyang

(10) Patent No.: US 11,064,740 B2
(45) Date of Patent: Jul. 20, 2021

(54) POWER SUPPLY AND ELECTRONIC CIGARETTE HAVING SAME

(71) Applicant: SHENZHEN IVPS TECHNOLOGY CO., LTD., Shenzhen (CN)

(72) Inventor: Junwei Ouyang, Shenzhen (CN)

(73) Assignee: SHENZHEN IVPS TECHNOLOGY CO., LTD., Guangdong (CN)

( * ) Notice: Subject to any disclaimer, the term of this patent is extended or adjusted under 35 U.S.C. 154(b) by 418 days.

(21) Appl. No.: 16/149,202

(22) Filed: Oct. 2, 2018

(65) Prior Publication Data

US 2020/0008466 A1 Jan. 9, 2020

(30) Foreign Application Priority Data

Jul. 5, 2018 (CN) ..... 201821066919.0

(51) Int. Cl.

| | |
|---|---|
| ***A24F 40/51*** | (2020.01) |
| ***H05B 1/02*** | (2006.01) |
| *A24F 40/10* | (2020.01) |
| *A24F 40/40* | (2020.01) |

(52) U.S. Cl.

CPC ..... *A24F 40/51* (2020.01); *H05B 1/0297* (2013.01); *A24F 40/10* (2020.01); *A24F 40/40* (2020.01)

(58) Field of Classification Search

CPC ..... A24F 47/008; A24F 47/40; A24F 47/90; A24F 47/00; A24F 47/02; A24F 47/004; A24F 15/01; A24F 40/51; A24F 40/10; A24F 40/40; H05B 1/0297; H05B 40/10; H05B 40/40

USPC ..... 131/329

See application file for complete search history.

(56) References Cited

U.S. PATENT DOCUMENTS

| | | | | |
|---|---|---|---|---|
| 8,897,628 | B2 * | 11/2014 | Conley | A61M 11/042 392/386 |
| 2011/0265806 | A1 * | 11/2011 | Alarcon | A24F 40/90 131/273 |
| 2014/0261487 | A1 * | 9/2014 | Chapman | A24F 40/10 131/328 |
| 2015/0333561 | A1 * | 11/2015 | Alarcon | A24F 47/008 131/329 |

(Continued)

FOREIGN PATENT DOCUMENTS

| | | |
|---|---|---|
| CN | 107890142 A | 4/2018 |
| CN | 108078015 A | 5/2018 |

(Continued)

*Primary Examiner* — Harshad C Patel
(74) *Attorney, Agent, or Firm* — IP-PAL Patent US; Klaus Michael Schmid

(57) ABSTRACT

A power supply for an electronic cigarette includes a main body, a waterproof and breathable membrane and a pneumatic sensor. The main body is provided with an internal cavity in which the pneumatic sensor is mounted and a mounting part in which the external load is mounted; the mounting part is provided with an airflow passage communicated with the outside and the internal cavity; the waterproof and breathable membrane is mounted in the main body and covers the airflow passage. When the external load is mounted in the mounting part, an air channel inside the external load is communicated with the airflow passage; and when the pneumatic sensor senses that the airflow movement in the airflow passage reaches a preset threshold, the main body is triggered to control the external load.

16 Claims, 5 Drawing Sheets

(56) References Cited

U.S. PATENT DOCUMENTS

| | | | | |
|---|---|---|---|---|
| 2016/0073692 | A1 | 3/2016 | Alarcon et al. | |
| 2017/0238612 | A1* | 8/2017 | Daryani ..... | A24F 47/008 |

FOREIGN PATENT DOCUMENTS

| | | | |
|---|---|---|---|
| WO | 2015120591 | A1 | 8/2015 |
| WO | 2018055334 | A1 | 3/2018 |
| WO | 2018057957 | A1 | 3/2018 |

* cited by examiner

POWER SUPPLY AND ELECTRONIC CIGARETTE HAVING SAME

TECHNICAL FIELD

The invention relates to a power supply for an electronic cigarette and an electronic cigarette using the power supply for an electronic cigarette.

BACKGROUND

With the gradual development of the electronic cigarette industry, small electronic cigarettes are more and more popular among consumers. In order to reduce the volume of the product, a sensor is usually used to sense the smoke of a user to trigger, so that the electronic cigarette atomizes the stored tobacco liquid into smoke for the user to smoke.

However, the sensor needs to be communicated with the air passage through which the electronic cigarette is suctioned to be triggered when the user smokes. During the long-term smoking process, the condensed water generated during the atomization process of the stored tobacco liquid will be accumulated in the electronic cigarette cavity, and the surface of the electronic cigarette sensor is usually provided with a dust cloth, which is easy to absorb tobacco liquid and condensed water, resulting in a reduced sensitivity and even a phenomenon of short-circuit damage.

SUMMARY

The main object of the invention is to provide a power supply for an electronic cigarette, which is intended to prevent the penetration of tobacco liquid and condensed water from causing damage to the pneumatic sensor.

In order to achieve the above object, the invention provides a power supply for an electronic cigarette, comprising a main body, a waterproof and breathable membrane and a pneumatic sensor, wherein the main body is provided with an internal cavity in which the pneumatic sensor is mounted and a mounting part in which the external load is mounted, the mounting part is provided with an airflow passage, the airflow passage is communicated with the outside and the internal cavity, the waterproof and breathable membrane is mounted in the main body and covers the airflow passage; when the external load is mounted in the mounting part, the air channel inside the external load is communicated with the airflow passage, and when the pneumatic sensor senses that the airflow movement in the airflow passage reaches a preset threshold, the main body is triggered to control the external load.

Preferably, the main body is provided with a mounting groove at a junction of the airflow passage and the outside, the waterproof and breathable membrane is mounted in the mounting groove, and the waterproof and breathable membrane has a thickness value H greater than or equal to the depth value h of the mounting groove, so that when the waterproof and breathable membrane is mounted in the mounting groove, the surface of the waterproof and breathable membrane exposed to the outside is even with the notch plane of the mounting groove, or higher than the notch plane of the mounting groove.

Preferably, the waterproof and breathable membrane comprises a substrate having waterproof and breathable property and an anti-wrinkle ring, the anti-wrinkle ring covers the edge of the substrate so that when the substrate is mounted in the main body, the portion of the substrate which is not covered by the anti-wrinkle ring covers the airflow passage and forms a breathable part, and the breathable part is communicated with the airflow passage through an air channel.

Preferably, the waterproof and breathable membrane further comprises an adhesive layer, the adhesive layer is provided on the surface of the substrate far away from the anti-wrinkle ring so that the substrate is adhered to the main body, and the adhesive layer is provided to avoid the breathable part of the substrate; and/or, the substrate has a thickness value of 0.02 mm to 0.11 mm.

The invention further provides a power supply for an electronic cigarette, comprising a main body, a waterproof and breathable membrane and a pneumatic sensor, wherein the main body comprises a housing, a frame and a sealing member; one end of the frame is provided with a mounting part in which the external load is mounted, and the other end thereof and the housing encircle a receiving space configured to receive an electronic component; the mounting part is provided with an airflow passage connecting the receiving space and the outside, the sealing member comprises a cover part and an air guiding part connected to the cover part, the cover part is mounted in the receiving space and is provided with an internal cavity configured to receive the pneumatic sensor, and the air guiding part is inserted into the airflow passage so that the airflow passage is communicated with the internal cavity; the waterproof and breathable membrane is mounted in the frame and covers the airflow passage.

Preferably, the frame is provided with a mounting groove at a junction of the airflow passage and the outside, the waterproof and breathable membrane is mounted in the mounting groove, and the waterproof and breathable membrane has a thickness greater than or equal to the depth of the mounting groove, so that when the waterproof and breathable membrane is mounted in the mounting groove, the surface of the waterproof and breathable membrane exposed to the outside is even with the notch plane of the mounting groove, or higher than the notch plane of the mounting groove.

Preferably, the air guiding part is provided with at least one air passing hole, and the outer peripheral surface of the air guiding part abuts against the inner peripheral surface of the airflow passage so that the airflow moves from the internal cavity and the airflow passage only through the air passing hole.

Preferably, the frame is provided with an mounting pocket having an opening to form the mounting part, the inner wall of the mounting pocket is provided with a through hole communicated with the receiving space to form the airflow passage, the external load is inserted into the mounting pocket and is spaced apart from the inner wall of the mounting pocket to form an air inlet passage, and the air inlet passage is communicated with the outside and the airflow passage.

Preferably, the main body further comprises an electrode component, wherein the electrode component comprises an insulating mounting plate and at least two output electrodes, the two output electrodes are spaced apart from each other and pass through the mounting plate, the mounting pocket is provided with an avoidance groove and at least two avoidance holes, the mounting plate is fixedly mounted in the avoidance groove and the mounting plate is further provided with a protective edge corresponding to each of the output electrodes in a protruding manner, the protective edge covers a portion of the outer surface of the output electrodes so that when the output electrodes pass through the avoidance hole, the output electrodes are spaced apart from the inner hole wall of the avoidance hole, and when the external load is mounted in the mounting pocket, the output electrodes are electrically communicated with the external load and the main body.

The invention further provides an electronic cigarette, wherein the electronic cigarette comprises an external load and a power supply for an electronic cigarette. The external load is a heating device that stores tobacco liquid or tobacco products. The power supply for an electronic cigarette comprises a main body, a waterproof and breathable membrane and a pneumatic sensor. The main body is provided with an internal cavity in which the pneumatic sensor is mounted and a mounting part in which the external load is mounted, the mounting part is provided with an airflow passage, the airflow passage is communicated with the outside and the internal cavity, the waterproof and breathable membrane is mounted in the main body and covers the airflow passage; when the external load is mounted in the mounting part, the air channel inside the external load is communicated with the airflow passage, and when the pneumatic sensor senses that the airflow movement in the airflow passage reaches a preset threshold, the main body is triggered to control the external load.

The power supply for an electronic cigarette of the technical solution of the invention is provided with a waterproof and breathable membrane to cover the airflow passage, and the air channel inside the external load is still communicated with the airflow passage, thereby effectively preventing tobacco liquid and condensed water generated during the use from penetrating into the internal cavity through the airflow passage to cause damage to the pneumatic sensor. At the same time, the sensing performance of the original pneumatic sensor is not affected so that it is unnecessary to customize a waterproof pneumatic sensor, which effectively saves the use cost. When more tobacco liquid and condensed water are concentrated and the smoking sensitivity is lowered, the sensing sensitivity of the pneumatic sensor can be restored only by shaking the power supply for an electronic cigarette so that the tobacco liquid and the condensed water are separated from the waterproof and breathable membrane.

BRIEF DESCRIPTION OF THE DRAWINGS

For a better illustration of the embodiments of the invention or the technical solution in the prior art, accompanying drawings needed in the description of the embodiments or the prior art are simply illustrated below. Obviously, the accompanying drawings described below are some embodiments of the invention. For those skilled in the art, other accompanying drawings may be obtained according to the structure shown in these accompanying drawings without creative work.

DESCRIPTION OF THE REFERENCE NUMBERS

Figure 1:
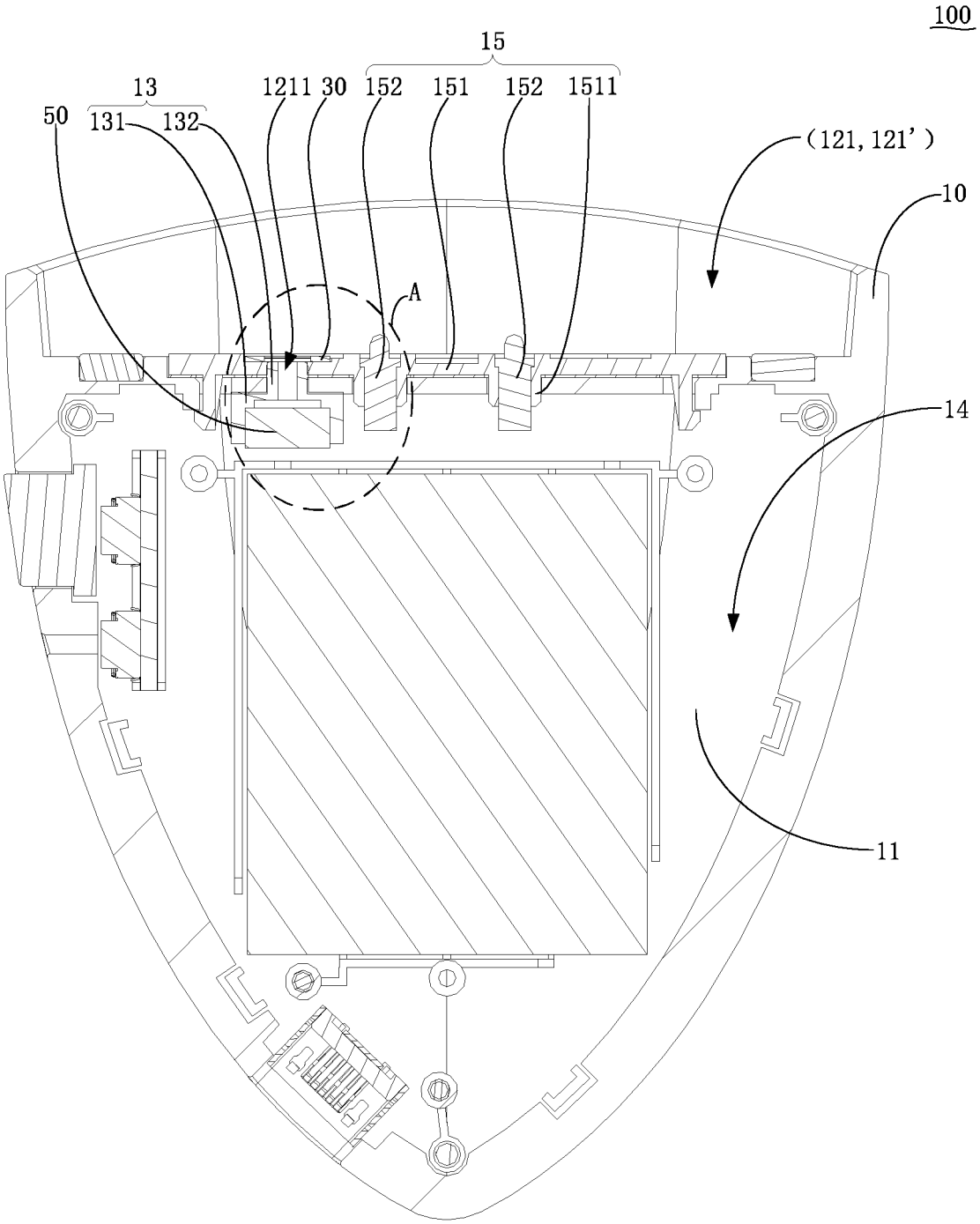
FIG. 1 is an exploded schematic diagram illustrating a connecting structure of a power supply for an electronic cigarette according to the invention.

| Reference number | Name of part |
|---|---|
| 100 | power supply for an electronic cigarette |
| 10 | main body |
| 11 | housing |
| 12 | frame |
| 121 | mounting part |
| 121' | mounting pocket |
| 1211 | airflow passage |
| 1212 | air inlet passage |
| 122 | mounting groove |
| 1221 | notch plane |
| 13 | sealing member |
| 131 | cover part |
| 1311 | internal cavity |
| 132 | air guiding part |
| 1321 | air passing hole |
| 14 | receiving space |
| 15 | electrode component |
| 151 | mounting plate |
| 1511 | protective edge |
| 152 | output electrode |
| 30 | waterproof and breathable membrane |
| 31 | substrate |
| 311 | breathable part |
| 32 | anti-wrinkle ring |
| 33 | adhesive layer |
| 50 | pneumatic sensor |
| 200 | heating device |
| 1000 | electronic cigarette |

The implementation of aims, the function features and the advantages of the present disclosure are described below in further detail in conjunction with embodiments with reference to the drawings.

DESCRIPTION OF THE EMBODIMENTS

A clear and complete description as below is provided for the technical solution in the embodiments of the invention in conjunction with the drawings in the embodiments of the invention. Obviously, the embodiments described hereinafter are simply part embodiments of the invention, rather than all the embodiments. All other embodiments obtained by those skilled in the art based on the embodiments in the invention without creative work are intended to be included in the scope of protection of the invention.

It should be noted that all directional indications (such as top, bottom, left, right, front, behind . . . ) in the embodiments of the invention are merely to illustrate a relative position relation, a relative motion condition, etc. between each part in a certain state (for example, the state shown in the drawings). If the state changes, the directional indication changes accordingly.

In addition, if terms "first", "second", etc. appear in the invention, they are merely for the purpose of description, but cannot be understood as the indication or implication of relative importance or as the implicit indication of the number of the designated technical features; therefore, features defined by "first" and "second" may specifically or implicitly comprise at least one such feature. In addition, technical solutions of each embodiment of the invention may be combined mutually; however, this must be carried out on the basis that those skilled in the art can implement the combination. When the combination of technical solutions has a conflict or cannot be implemented, it should be considered that such combination of technical solutions does not exist and is not in the scope of protection claimed by the invention.

In the invention, unless otherwise specifically stated and defined, terms "connected", "fixed", etc. should be interpreted expansively. For example, "fixed" may be fixed connection, detachable connection, or integration; may be mechanical connection or electrical connection; direct connection, indirect connection through an intermediate, or internal communication between two elements or interaction of two elements, unless otherwise specifically defined. Those skilled in the art can understand the specific implication of the above terms in the invention according to specific conditions.

The invention provides a power supply 100 for an electronic cigarette, which is configured to supply power to an external load when being triggered by the pneumatic sensor 50. Here, in the present embodiment, the external load is exemplified by a heating device 200. The power supply 100 for the electronic cigarette is combined with the heating device 200 to form an electronic cigarette 1000. The heating device 200 is internally provided with a storage space for storing tobacco liquid or tobacco products and a heat generating component. When the pneumatic sensor 50 is triggered, the power supply 100 for the electronic cigarette is driven to supply power to the heating device 200 so that the heat generating component heats the internally stored tobacco liquid or tobacco products, thereby generating smoke for the user to smoke. Here, in the present embodiment, the heating device 200 is exemplified by an atomizer that stores tobacco liquid. The atomizer is provided with an air inlet and an air outlet, and an atomizing air passage is formed between the air inlet and the air outlet. A heat generating component for heating tobacco liquid is provided in the atomizing air passage.

Referring to FIG. 1 to FIG. 6, the power supply 100 for an electronic cigarette comprises a main body 10, a waterproof and breathable membrane 30 and a pneumatic sensor 50, wherein the main body 10 is provided with an internal cavity 1311 in which the pneumatic sensor 50 is mounted and a mounting part 121 in which the external atomizer is mounted, the mounting part 121 is provided with an airflow passage 1211, the airflow passage 1211 is communicated with the outside and the internal cavity 1311, the waterproof and breathable membrane 30 is mounted in the main body 10 and covers the airflow passage 1211; when the atomizer is mounted in the mounting part 121, the air channel inside the atomizer is communicated with the airflow passage 1211, and when the pneumatic sensor 50 senses that the airflow movement in the airflow passage 1211 reaches a preset threshold, the main body 10 is triggered to control the atomizer.

The power supply 100 for an electronic cigarette of the technical solution of the invention is provided with a waterproof and breathable membrane 30 to cover the airflow passage 1211, and the air channel inside the external atomizer is still communicated with the airflow passage 1211, thereby effectively preventing tobacco liquid and condensed water generated during the use from penetrating into the internal cavity 1311 through the airflow passage 1211 to cause damage to the pneumatic sensor 50. At the same time, the sensing performance of the original pneumatic sensor 50 is not affected so that it is unnecessary to customize a waterproof pneumatic sensor 50, which effectively saves the use cost. When more tobacco liquid and condensed water are concentrated and the smoking sensitivity is lowered, the sensing sensitivity of the pneumatic sensor 50 can be restored only by shaking the power supply 100 for an electronic cigarette so that the tobacco liquid and the condensed water are separated from the waterproof and breathable membrane 30.

Here, in the present embodiment, the pneumatic sensor 50 uses a negative-pressure gas sensor switch, and encapsulates the circuit board integrated inside the power supply for the electronic cigarette through the SOT-23-5 technology. When the user smokes, air in the internal cavity 1311 is extracted from the airflow passage 1211, thereby generating an air pressure difference. When the generated air pressure difference reaches a preset threshold, the negative-pressure sensor is triggered so that the main body 10 supplies power to the atomizer. No physical buttons are required for controlling, which is convenient for user to manipulate. Here, the S087 negative-pressure gas sensor switch is used. The detection accuracy is –400*pa*, the trigger sensitivity is high, and the quiescent current is less than 5 uA in the power saving mode. The peripheral application circuit is simple, small in volume, and low in cost.

It is to be understood that, in practical applications, it is not limited to the method of triggering power supply using the negative-pressure sensor described above. For example, in another embodiment of the invention, the pneumatic sensor 50 may be formed by a combination of the trigger diaphragm and the electrode sheet. When the user smokes, the airflow in the internal cavity 1311 flows out through the airflow passage 1211, so that the trigger diaphragm vibrates. When the trigger diaphragm vibrates until being in contact with the electrode sheet, the trigger diaphragm is electrically communicated with the electrode sheet, so that the manner in which the main body 10 is triggered to supply power to the atomizer also falls within the scope of protection of the invention.

Figure 2:
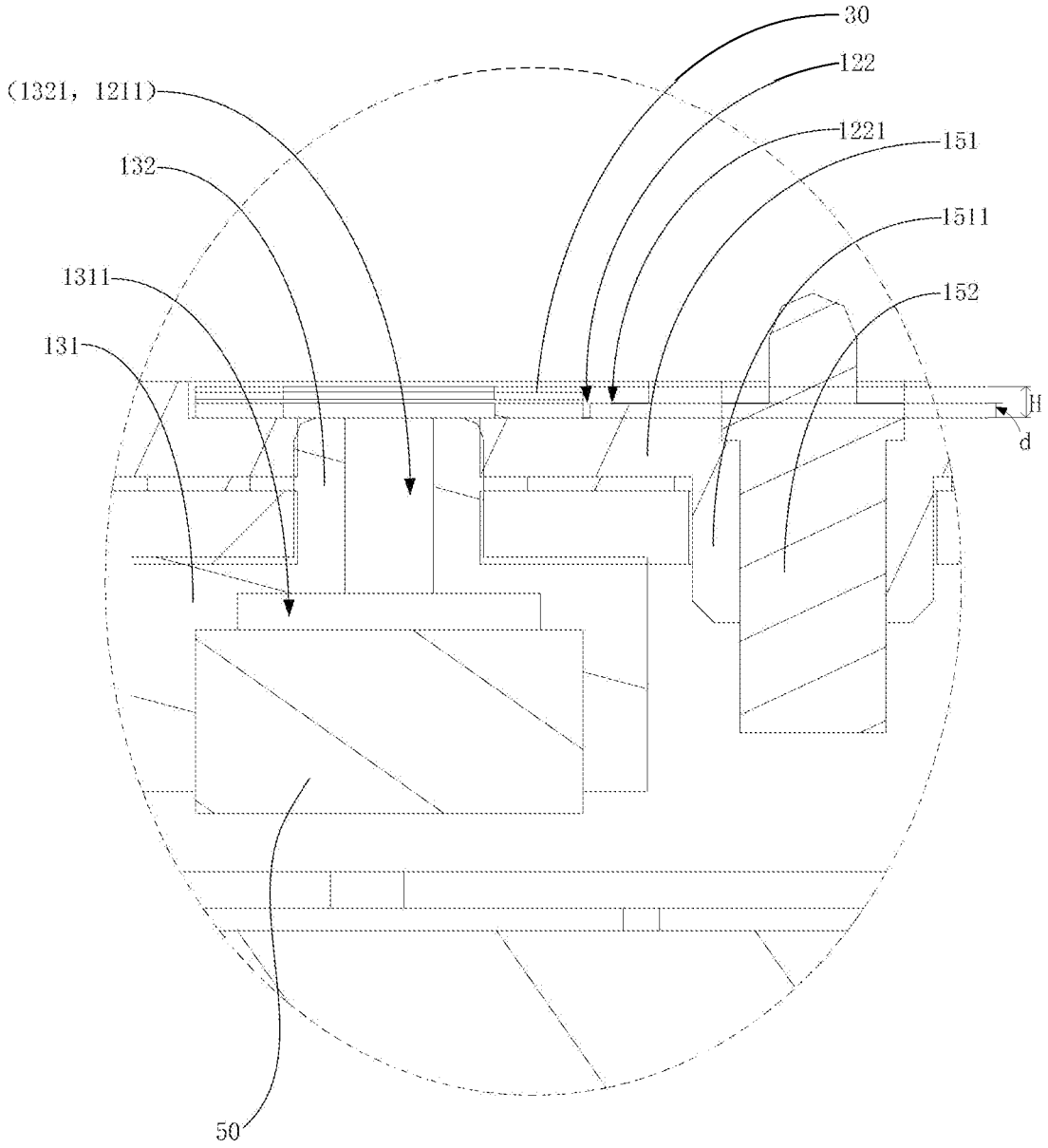
FIG. 2 is a partial enlarged schematic diagram illustrating part A shown in FIG. 1 according to the invention.

Specifically, as shown in FIG. 1 or FIG. 2, in the embodiment of the invention, the waterproof and breathable membrane 30 is mounted at one end of the airflow passage 1211 far away from the internal cavity 1311. Here, in the present embodiment, the waterproof and breathable membrane 30 covers the end of the airflow passage 1211 far away from an end of the internal cavity 1311, effectively preventing the phenomenon that tobacco liquid or condensed water penetrates into the airflow passage 1211 so that it is difficult to discharge.

It is to be understood that, in practical applications, the waterproof and breathable membrane 30 is not limited to being mounted to the end of the airflow passage 1211 far away from an end of the internal cavity 1311 as described above. For example, in another embodiment of the invention, the manner in which the waterproof and breathable membrane 30 may also be provided on the surface of the pneumatic sensor 50; or provided in the airflow passage 1211, and then provided with a drainage passage communicated with the airflow passage 1211 to discharge the tobacco liquid concentrated in the airflow passage 1211 falls within the scope of protection of the invention.

Figure 3:
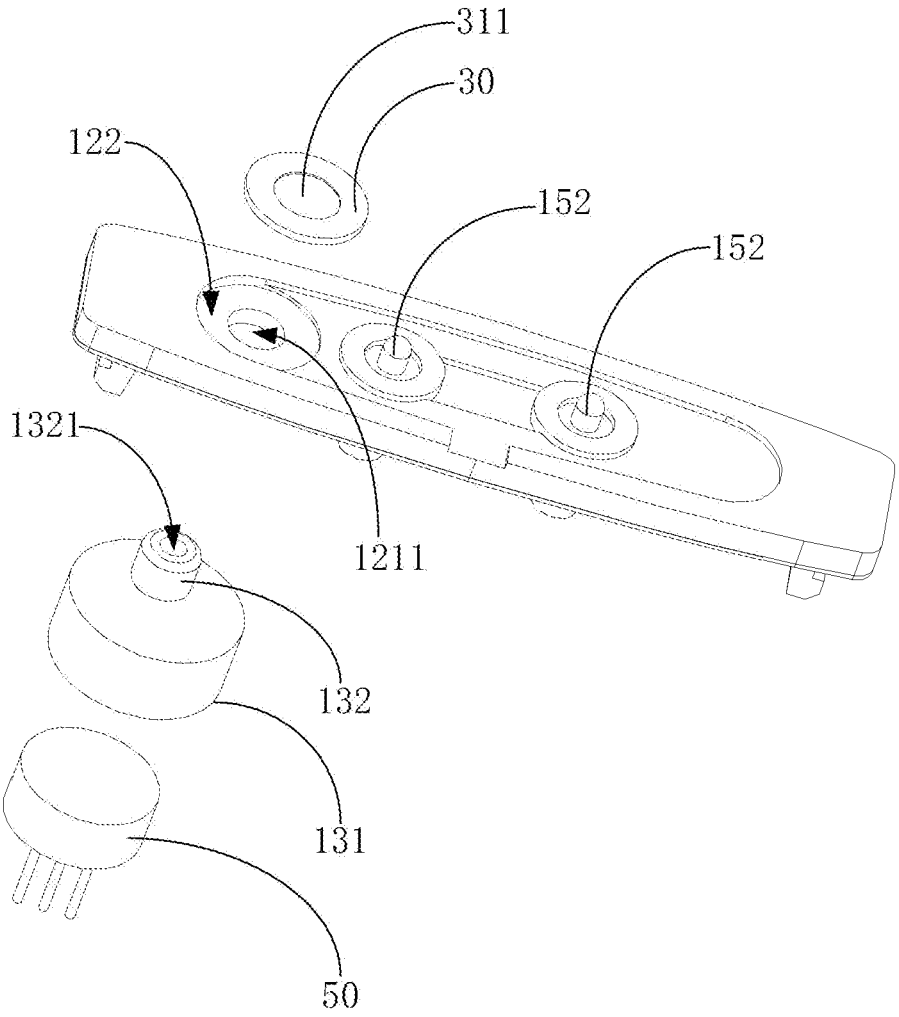
FIG. 3 is an exploded schematic diagram illustrating a connecting structure of a waterproof and breathable membrane mounted in an electrode component of a main body according to the invention.

Specifically, as shown in FIG. 2 and FIG. 3, in the embodiment of the invention, the main body 10 is provided with a mounting groove 122 in which the waterproof and breathable membrane 30 is mounted at a junction of the airflow passage and the outside, and the waterproof and breathable membrane 30 has a thickness value H greater than or equal to the depth value h of the mounting groove 122, so that when the waterproof and breathable membrane 30 is mounted in the mounting groove 122, the surface of the waterproof and breathable membrane 30 exposed to the outside is even (i.e., level) with the notch plane 1221 of the mounting groove 122, or higher than the notch plane 1221 of the mounting groove 122. Here, in the present embodiment, the main body 10 is provided with a mounting groove 122, the airflow passage 1211 is provided in the mounting groove 122, the waterproof and breathable membrane 30 covers the airflow passage 1211 when being mounted in the mounting groove 122, and the outer peripheral surface of the waterproof and breathable membrane 30 abuts against the inner groove wall of the mounting groove 122, which is convenient to position and mount and prevents the tobacco liquid and the condensed water from being deposited in the mounting groove 122. In addition, the waterproof and breathable membrane 30 has a thickness value H greater than or equal to the depth value h of the mounting groove 122, so that when the waterproof and breathable membrane 30 is mounted in the mounting groove 122, one end of the waterproof and breathable membrane 30 far away from the airflow passage 1211 is higher than the notch plane 1221 of the mounting groove 122, further efficiently preventing the phenomenon that the tobacco liquid and the condensed water are accumulated in the mounting groove 122 and cover the surface of the waterproof and breathable membrane 30 so that the trigger sensitivity is lowered; and the waterproof and breathable membrane 30 is higher than or even (i.e., level) with the notch plane 1221 of the mounting groove 122. When more tobacco liquid and condensed water is accumulated on the waterproof and breathable membrane 30, the tobacco liquid can be separated from the waterproof and breathable membrane 30 only by shaking the power supply 100 for an electronic cigarette. During cleaning, it is only necessary to absorb the tobacco liquid on the surface of the waterproof and breathable membrane 30 using a cotton swab, without inserting the cotton swab into the mounting groove 122 for adsorption, which is convenient to clean and efficiently prevents the phenomenon that the waterproof and breathable membrane 30 is damaged due to an excessive force when being inserted into the mounting groove 122.

It is to be understood that, in practical applications, it is not limited to the manner in which the waterproof and breathable membrane 30 is higher than the notch plane 1221 of the mounting groove 122 to prevent the tobacco liquid from being accumulated on the surface of the waterproof and breathable membrane 30. For example, in another embodiment of the invention, the manner in which the waterproof and breathable membrane 30 may also be formed into a cambered surface to cover the airflow passage 1211 so that the tobacco liquid and the condensed water on the surface of the waterproof and breathable membrane 30 slide down the cambered surface to avoid affecting the trigger sensitivity also falls within the scope of protection of the invention.

Figure 4:
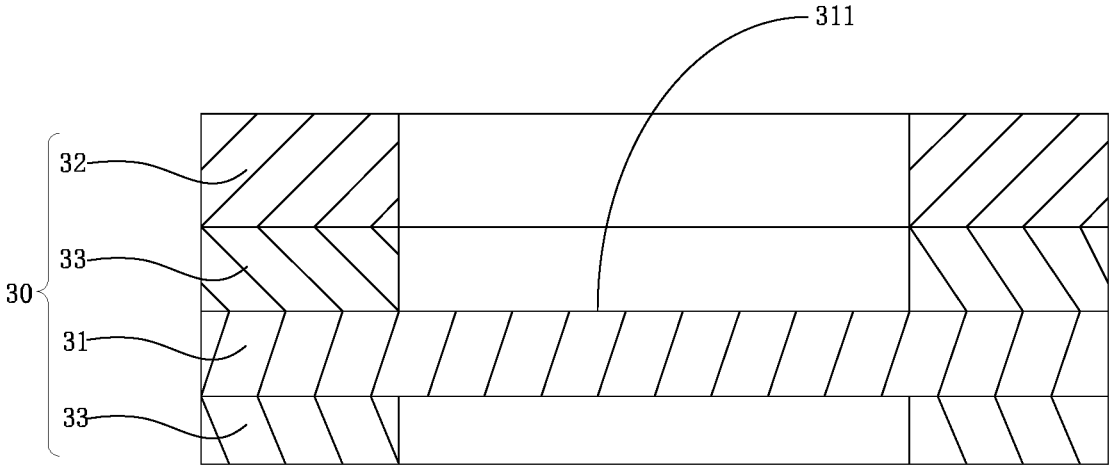
FIG. 4 is a cross-sectional schematic diagram illustrating a connecting structure of a waterproof and breathable membrane according to the invention.

Specifically, as shown in FIG. 4, in the embodiment of the invention, the waterproof and breathable membrane 30 comprises a substrate 31 having waterproof and breathable property and an anti-wrinkle ring 32, the anti-wrinkle ring 32 covers the edge of the substrate 31 so that when the substrate 31 is mounted in the main body 10, the portion of the substrate 31 which is not covered by the anti-wrinkle ring 32 covers the airflow passage 1211 and forms a breathable part 311, and the breathable part 311 is communicated with the airflow passage 1211 through an air channel. Here, in the present embodiment, the substrate 31 is formed by hot-melting a high-performance composite material, such as a TPU waterproof and breathable membrane 30, an EPTFE composite fabric, etc. The better waterproof and breathable property enables water vapor to pass freely, and at the same time, the condensed water dew is prevented from being penetrated into the internal cavity 1311 along the airflow passage 1211, thereby causing damage to the pneumatic sensor 50; at the same time, in order to ensure better breathable property, the thickness of the substrate 31 is preferably in the range of 0.02 mm to 0.11 mm, and is more preferably 0.06 mm in the present embodiment. Further, in order to prevent the substrate 31 from deforming and wrinkling during the movement of airflow, in the present embodiment, a hard anti-wrinkle ring 32 is covered on the edge of the substrate 31. The anti-wrinkle ring 32 may be selected from polymeric materials such as polyethylene terephthalate, polyethylene plastics, polypropylene plastics, fluoroplastics, polyvinyl chloride, and polyperfluoroethylene propylene. In the present embodiment, the anti-wrinkle ring 32 is prepared using polyethylene terephthalate, and is fixed to the substrate 31 by gluing, so that the substrate 31 has a certain tension to avoid wrinkles. At the same time, the substrate 31 not covered by the anti-wrinkle ring 32 forms a breathable part 311 through which the air in the airflow passage 1211 flows out.

Specifically, as shown in FIG. 4, in the embodiment of the invention, the waterproof and breathable membrane 30 further comprises an adhesive layer 33, the adhesive layer 33 is provided on the surface of the substrate 31 far away from the anti-wrinkle ring 32 so that the substrate 31 is adhered to the main body 10, and the adhesive layer 33 is provided to avoid the breathable part 311 of the substrate 31. Here, in the present embodiment, the adhesive layer 33 is provided on the surface of the substrate 31 far away from the anti-wrinkle ring 32. When the substrate 31 is adhered to the mounting groove 122, the hard wrinkle ring 32 protrudes from the outside, effectively preventing the phenomenon of abrasion and breakage of the substrate 31.

It is to be understood that, in practical applications, the adhesive layer 33 is not limited to being provided on the surface of the substrate 31 far away from the anti-wrinkle ring 32 as described above. For example, the manner in which the adhesive layer 33 may be also provided on the outer surface of the main body 10 or provided on the surface of the anti-wrinkle ring 32 far away from the substrate 31 and then the anti-wrinkle ring 32 is bonded to the main body 10 so as to fix the substrate 31 to the main body 10 falls within the scope of protection of the invention.

Further, as shown in FIG. 1, the invention further provides a power supply for an electronic cigarette. In this embodiment, the power supply for an electronic cigarette comprises a main body 10, a waterproof and breathable membrane 30 and a pneumatic sensor 50, wherein the main body 10 comprises a housing 11, a frame 12 and a sealing member 13; one end of the frame 12 is provided with a mounting part 121 in which the external load is mounted, and the other end thereof and the housing 11 encircle a receiving space 14 configured to receive an electronic component; the mounting part 121 is provided with an airflow passage 1211 connecting the receiving space 14 and the outside, the cover part 131 is mounted in the receiving space 14 and is provided with an internal cavity 1311 configured to receive the pneumatic sensor 50, and the air guiding part 132 is inserted into the airflow passage 1211 so that the airflow passage 1211 is communicated with the internal cavity 1311. Here, in the present embodiment, the cover part 131 and the air guiding part 132 are integrally formed of an elastic silicone material to form the sealing member 13. The pneumatic sensor 50 is mounted in the internal cavity 1311. The outer peripheral surface of the pneumatic sensor 50 abuts against the inner peripheral surface of the internal cavity 1311 so that a cavity of a smaller volume is formed in the internal cavity 1311. The cavity is communicated with the air guiding part 132. The air guide portion 132 is inserted into the airflow passage 1211 so that the airflow passage 1211 is communicated with the internal cavity 1311. When the user smokes, the airflow in the internal cavity 1311 is extracted through the air guiding part 132, which facilitates the formation of the air pressure difference, and effectively improves the sensitivity of the pneumatic sensor 50.

Figure 5:
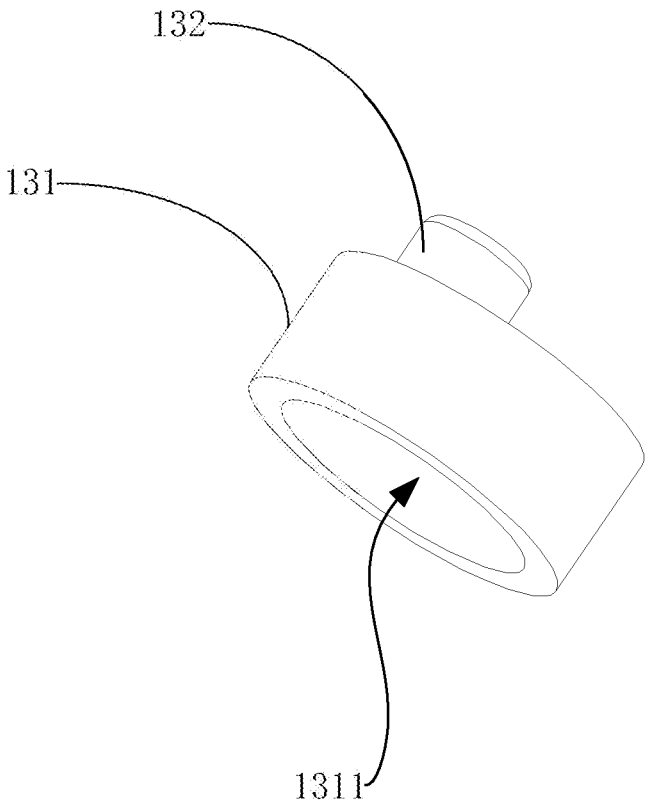
FIG. 5 is a perspective schematic diagram illustrating a connecting structure of a sealing member according to the invention.

Specifically, as shown in FIG. 3 and FIG. 5, in the embodiment of the invention, the air guiding part 132 is provided with at least one air passing hole 1321, and the outer peripheral surface of the air guiding part 132 abuts against the inner peripheral surface of the airflow passage 1211 so that the airflow moves from the internal cavity 1311 and the airflow passage 1211 only through the air passing hole 1321. Here, in the present embodiment, the outer peripheral surface of the air guiding part 132 abuts against the inner peripheral surface of the airflow passage 1211 so that the airflow flows from the internal cavity 1311 and the airflow passage 1211 only through the air passing hole 1311, effectively preventing a gap formed between the air guiding part 132 and the airflow passage 1211 from being communicated with the receiving space 14 inside the main body 10, that is, preventing the phenomenon that when the user smokes, the air in the receiving space 14 flows into the airflow passage 1211 through the gap so that the amount of airflow flowing into the airflow passage 1211 from the cavity is reduced and the pneumatic sensor 50 cannot be triggered, further improving the trigger sensitivity of the pneumatic sensor 50.

Specifically, as shown in FIG. 1, in the embodiment of the invention, the frame 12 is provided with an mounting pocket 121' having an opening to form the mounting part 121, the inner wall of the mounting pocket 121' is provided with a through hole communicated with the receiving space 14 to form the airflow passage 1211, the external atomizer is inserted into the mounting pocket 121' and is spaced apart from the inner wall of the mounting pocket 121' to form an air inlet passage, and the air inlet passage is communicated with the outside and the airflow passage 1211. Here, in the present embodiment, one end of the frame 12 is provided with a mounting pocket 121' having an opening. The surface of the mounting pocket 121' facing the air inlet of the atomizer is provided with a through hole. The through hole is communicated with the internal cavity 1311 to form the airflow passage 1211. When the external atomizer is inserted into the mounting pocket 121', a portion of the inner wall of the mounting pocket 121' is spaced apart from the outer peripheral surface of the atomizer to form an air inlet passage. When the user smokes, the external airflow flows into the air inlet through the air inlet passage to provide airflow for the normal operation of the atomizer. At the same time, the airflow passage 1211 is provided on the surface adjacent to the air inlet to ensure that the airflow in the internal cavity 1311 can be preferentially and quickly extracted when the user smokes, thereby generating an air pressure difference to trigger the pneumatic sensor 50, and further improving the sensitivity of the pneumatic sensor 50.

Further, as shown in FIG. 1 and FIG. 3, in the embodiment of the invention, the main body 10 further comprises an electrode component 15, wherein the electrode component 15 comprises an insulating mounting plate 151 and at least two output electrodes 152, the two output electrodes 152 are spaced apart from each other and pass through the mounting plate 151, the mounting pocket 121' is provided with an avoidance groove and at least two avoidance holes, the mounting plate 151 is fixedly mounted in the avoidance groove and the mounting plate 151 is further provided with a protective edge 1511 corresponding to each of the output electrodes 152 in a protruding manner, the protective edge 1511 covers a portion of the outer surface of the output electrodes 152 so that when the output electrodes 152 pass through the avoidance hole, the output electrodes 152 are spaced apart from the inner hole wall of the avoidance hole, and when the external atomizer is mounted in the mounting pocket 121', the output electrodes 152 are electrically communicated with the atomizer and the main body 10. Here, in the present embodiment, the electrode component 15 comprises a positive output electrode 152 and a negative output electrode 152; the frame 12 is made of a metal material, the mounting plate 151 is made of an insulating plastic material, and the frame 12 made of a metal material is high in connecting strength, effectively enhancing the service life. The output positive electrode and the output negative electrode are mounted in the mounting plate 151 in an interference fit manner, the protective edge 1511 wraps a portion of the outer surface of the electrode component 15; and then the mounting plate 151 is mounted in the mounting groove 122 in an interference fit manner. The protective edge 1511 is interference-fitted with the inner hole wall of the avoidance hole, thereby effectively preventing the oil from penetrating into the receiving space 14 inside the main body 10 to damage the internal electronic components, and preventing the phenomenon that the electrode component 15 is in direct contact with the frame 12 so as to result in a short circuit at the same time.

Figure 6:
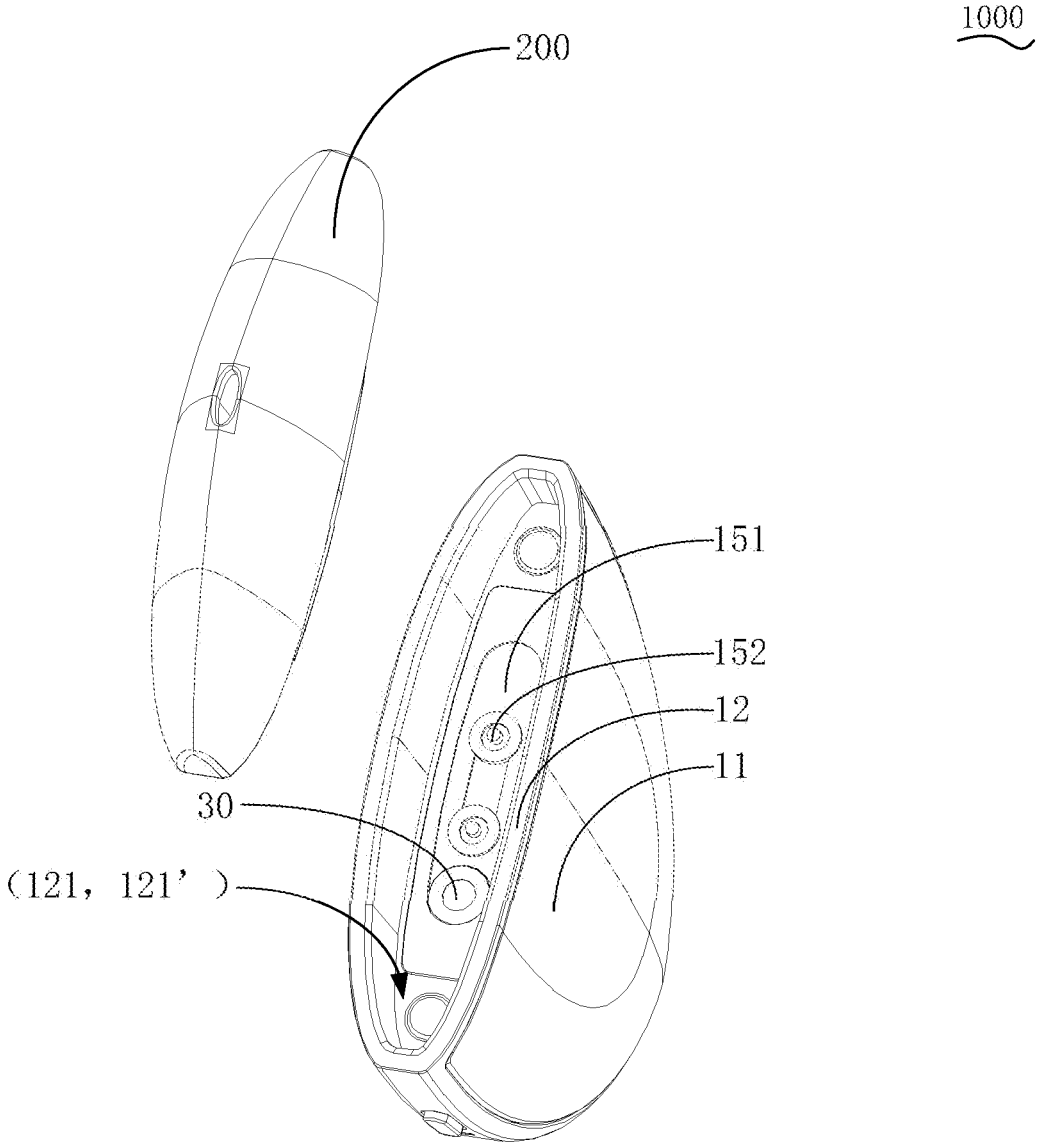
FIG. 6 is an exploded schematic diagram illustrating a connecting structure of an electronic cigarette according to the invention.

Referring to FIG. 6, the invention further provides an electronic cigarette 1000, wherein the electronic cigarette 1000 further comprises a heating device 200 and a power supply 100 for an electronic cigarette. Refer to the above embodiment for the specific structure of the power supply 100 for an electronic cigarette. Due to the use of all the technical solutions of all the above embodiments, the electronic cigarette 1000 has at least all the beneficial effects brought by the technical solutions of the above embodiments, which will not be described in detail herein.

The above are preferred embodiments of the invention merely and are not intended to limit the patent scope of the invention. Any equivalent structures made according to the description and the accompanying drawings of the invention without departing from the idea of the invention, or any equivalent structures applied in other relevant technical fields directly or indirectly are intended to be included in the patent protection scope of the invention.

What is claimed is:

1. A power supply for an electronic cigarette, the power supply comprising a main body, a waterproof and breathable membrane and a pneumatic sensor, wherein the main body is provided with an internal cavity in which the pneumatic sensor is mounted and a mounting part in which an external load is mounted, the mounting part is provided with an airflow passage, the airflow passage is communicated with outside and the internal cavity, the waterproof and breathable membrane is mounted in the main body and covers the airflow passage; when the external load is mounted in the mounting part, an air channel inside the external load is communicated with the airflow passage, and when the pneumatic sensor senses that an airflow movement in the airflow passage reaches a preset threshold, the main body is triggered to control the external load.

2. The power supply for an electronic cigarette according to claim 1, wherein the main body is provided with a mounting groove at a junction of the airflow passage and the outside, the waterproof and breathable membrane is mounted in the mounting groove, and the waterproof and breathable membrane has a thickness greater than or equal to the depth of the mounting groove, so that when the waterproof and breathable membrane is mounted in the mounting groove, the surface of the waterproof and breathable membrane exposed to the outside is even with the notch plane of the mounting groove, or higher than the notch plane of the mounting groove.

3. The power supply for an electronic cigarette according to claim 1, wherein the waterproof and breathable membrane comprises a substrate having waterproof and breathable property and an anti-wrinkle ring, the anti-wrinkle ring covers the edge of the substrate so that when the substrate is mounted in the main body, the portion of the substrate which is not covered by the anti-wrinkle ring covers the airflow passage and forms a breathable part, and the breathable part is communicated with the airflow passage through an air channel.

4. The power supply for an electronic cigarette according to claim 2, wherein the waterproof and breathable membrane comprises a substrate having waterproof and breathable property and an anti-wrinkle ring, the anti-wrinkle ring covers the edge of the substrate so that when the substrate is mounted in the main body, the portion of the substrate which is not covered by the anti-wrinkle ring covers the airflow passage and forms a breathable part, and the breathable part is communicated with the airflow passage through an air channel.

5. The power supply for an electronic cigarette according to claim 3, wherein the waterproof and breathable membrane further comprises an adhesive layer, the adhesive layer is provided on the surface of the substrate far away from the anti-wrinkle ring so that the substrate is adhered to the main body, and the adhesive layer is provided to avoid the breathable part of the substrate; and/or, the substrate has a thickness value of 0.02 mm to 0.11 mm.

6. The power supply for an electronic cigarette according to claim 4, wherein the waterproof and breathable membrane further comprises an adhesive layer, the adhesive layer is provided on the surface of the substrate far away from the anti-wrinkle ring so that the substrate is adhered to the main body, and the adhesive layer is provided to avoid the breathable part of the substrate; and/or, the substrate has a thickness value of 0.02 mm to 0.11 mm.

7. A power supply for an electronic cigarette, the power supply comprising a main body, a waterproof and breathable membrane and a pneumatic sensor, wherein the main body comprises a housing, a frame and a sealing member; one end of the frame is provided with a mounting part in which an external load is mounted, and the other end thereof and the housing encircle a receiving space, the receiving space is configured for receiving an electronic component;

wherein the mounting part is provided with an airflow passage connecting the receiving space and outside, the sealing member comprises a cover part and an air guiding part connected to the cover part, the cover part is mounted in the receiving space and is provided with an internal cavity configured to receive the pneumatic sensor, and the air guiding part is inserted into the airflow passage so that the airflow passage is communicated with the internal cavity; and wherein the waterproof and breathable membrane is mounted in the frame and covers the airflow passage.

8. The power supply for an electronic cigarette according to claim 7, wherein the frame is provided with a mounting groove at a junction of the airflow passage and the outside, the waterproof and breathable membrane is mounted in the mounting groove, and the waterproof and breathable membrane has a thickness greater than or equal to the depth of the mounting groove, so that when the waterproof and breathable membrane is mounted in the mounting groove, the surface of the waterproof and breathable membrane exposed to the outside is even with the notch plane of the mounting groove, or higher than the notch plane of the mounting groove.

9. The power supply for an electronic cigarette according to claim 7, wherein the waterproof and breathable membrane comprises a substrate having waterproof and breathable property and an anti-wrinkle ring, the anti-wrinkle ring covers the edge of the substrate so that when the substrate is mounted in the main body, the portion of the substrate which is not covered by the anti-wrinkle ring covers the airflow passage and forms a breathable part, and the breathable part is communicated with the airflow passage through an air channel.

10. The power supply for an electronic cigarette according to claim 8, wherein the waterproof and breathable membrane comprises a substrate having waterproof and breathable property and an anti-wrinkle ring, the anti-wrinkle ring covers the edge of the substrate so that when the substrate is mounted in the main body, the portion of the substrate which is not covered by the anti-wrinkle ring covers the airflow passage and forms a breathable part, and the breathable part is communicated with the airflow passage through an air channel.

11. The power supply for an electronic cigarette according to claim 9, wherein the waterproof and breathable membrane further comprises an adhesive layer, the adhesive layer is provided on the surface of the substrate far away from the anti-wrinkle ring so that the substrate is adhered to the main body, and the adhesive layer is provided to avoid the breathable part of the substrate; and/or, the substrate has a thickness value of 0.02 mm to 0.11 mm.

12. The power supply for an electronic cigarette according to claim 10, wherein the waterproof and breathable membrane further comprises an adhesive layer, the adhesive layer is provided on the surface of the substrate far away from the anti-wrinkle ring so that the substrate is adhered to the main body, and the adhesive layer is provided to avoid the breathable part of the substrate; and/or, the substrate has a thickness value of 0.02 mm to 0.11 mm.

13. The power supply for an electronic cigarette according to claim 7, wherein the air guiding part is provided with at least one air passing hole, and the outer peripheral surface of the air guiding part abuts against the inner peripheral surface of the airflow passage so that the airflow moves from the internal cavity and the airflow passage only through the air passing hole.

14. The power supply for an electronic cigarette according to claim 7, wherein the frame is provided with an mounting pocket having an opening to form the mounting part, the inner wall of the mounting pocket is provided with a through hole communicated with the receiving space to form the airflow passage, the external load is inserted into the mounting pocket and is spaced apart from the inner wall of the mounting pocket to form an air inlet passage, and the air inlet passage is communicated with the outside and the airflow passage.

15. The power supply for an electronic cigarette according to claim 14, wherein the main body further comprises an electrode component, wherein the electrode component comprises an insulating mounting plate and at least two output electrodes, the two output electrodes are spaced apart from each other and pass through the mounting plate, the mounting pocket is provided with an avoidance groove and at least two avoidance holes, the mounting plate is fixedly mounted in the avoidance groove and the mounting plate is further provided with a protective edge corresponding to each of the output electrodes in a protruding manner, the protective edge covers a portion of the outer surface of the output electrodes so that when the output electrodes pass through the avoidance hole, the output electrodes are spaced apart from the inner hole wall of the avoidance hole, and when the external load is mounted in the mounting pocket, the output electrodes are electrically communicated with the external load and the main body.

16. An electronic cigarette comprising an external load, wherein the electronic cigarette further comprises the power supply for an electronic cigarette according to claim 1; and/or the electronic cigarette further comprises the power supply for an electronic cigarette according to claim 7.

* * * * *